US011305563B1

(12) United States Patent
Escudero Gonzalez

(10) Patent No.: US 11,305,563 B1
(45) Date of Patent: Apr. 19, 2022

(54) APPARATUS TO FLATTEN A SUBSTRATE ALONG A PRINT PATH OF A PRINTER

(71) Applicant: Electronics for Imaging, Inc., Fremont, CA (US)

(72) Inventor: Juan Escudero Gonzalez, Almazora (ES)

(73) Assignee: ELECTRONICS FOR IMAGING, INC., Fremont, CA (US)

( * ) Notice: Subject to any disclaimer, the term of this patent is extended or adjusted under 35 U.S.C. 154(b) by 0 days.

(21) Appl. No.: 17/127,580

(22) Filed: Dec. 18, 2020

Related U.S. Application Data

(60) Provisional application No. 63/122,823, filed on Dec. 8, 2020.

(51) Int. Cl.

| | |
|---|---|
| ***B41J 11/00*** | (2006.01) |
| ***B41J 15/16*** | (2006.01) |
| ***B41J 29/38*** | (2006.01) |
| ***B41J 15/04*** | (2006.01) |
| ***B41J 13/14*** | (2006.01) |

(52) U.S. Cl.
CPC ..... *B41J 15/16* (2013.01); *B41J 11/005* (2013.01); *B41J 13/14* (2013.01); *B41J 15/048* (2013.01); *B41J 29/38* (2013.01)

(58) Field of Classification Search
CPC ..... B41J 11/005
See application file for complete search history.

(56) References Cited

U.S. PATENT DOCUMENTS

| | | | |
|---|---|---|---|
| 1,675,525 | A | 7/1928 | Kyle |
| 2,160,906 | A | 6/1939 | Robert |
| 2,294,406 | A | 9/1942 | Huffman |
| 2,769,522 | A | 11/1956 | Pfeiffer |
| 2,916,286 | A | 12/1959 | Keating |
| 2,923,543 | A | 2/1960 | Metzner et al. |
| 3,215,255 | A | 11/1965 | Carter |
| 3,272,504 | A | 9/1966 | Schnoebelen |
| 3,309,078 | A | 3/1967 | Dale |
| 3,388,905 | A | 6/1968 | Dale et al. |
| 3,802,546 | A | 4/1974 | Helms |
| 3,951,402 | A | 4/1976 | Skinner |
| 4,351,601 | A | 9/1982 | Cormier et al. |

(Continued)

FOREIGN PATENT DOCUMENTS

| | | |
|---|---|---|
| ES | 2679894 B1 | 4/2019 |
| WO | 2018048453 A1 | 3/2018 |

OTHER PUBLICATIONS

"HP PageWide C500 Product Video", retrieved online from url: https://www.youtube.com/watch?v=K-b7Kaxwrc0, Nov. 16, 2018.

*Primary Examiner* — Julian D Huffman
(74) *Attorney, Agent, or Firm* — Perkins Coie LLP

(57) ABSTRACT

Disclosed here is an apparatus to flatten the substrate as the substrate travels along the print path of a printer, thus reducing damage to the transport belt, motor, gearbox, etc., and increasing print quality. The apparatus includes two strapping metal bands mounted on the printer and parallel to the print path. The two strapping metal bands are under tension from a torsion spring and a ratchet placed at least at one end of the print path. In a rest position, the two strapping metal bands are lifted off the transport belt. When a printhead of the printer lowers to engage in printing, the printhead pushes on the two strapping metal bands causing them to push the edges of the substrate downward, thus increasing the flatness of the substrate.

20 Claims, 18 Drawing Sheets

(56) References Cited

U.S. PATENT DOCUMENTS

| | | | |
|---|---|---|---|
| 4,506,879 | A | 3/1985 | Goodwin et al. |
| 4,526,358 | A | 7/1985 | Ura et al. |
| 4,536,772 | A | 8/1985 | Isogai |
| 4,673,306 | A | 6/1987 | Rubinstein et al. |
| 4,836,527 | A | 6/1989 | Wong |
| 4,934,687 | A | 6/1990 | Hayden et al. |
| 4,942,426 | A | 7/1990 | Jones et al. |
| 5,295,676 | A | 3/1994 | Kenin et al. |
| 5,296,874 | A | 3/1994 | Nagata et al. |
| 5,574,551 | A | 11/1996 | Kazakoff |
| 5,686,950 | A | 11/1997 | Hirakue |
| 6,039,481 | A | 3/2000 | Ham |
| 6,042,106 | A | 3/2000 | Kelly et al. |
| 8,292,421 | B2 | 10/2012 | Mandel et al. |
| 9,028,160 | B2 | 5/2015 | Garcia et al. |
| 9,272,550 | B2 | 3/2016 | Ito et al. |
| 9,790,047 | B2 | 10/2017 | Snir |
| 10,265,978 | B2 | 4/2019 | Vaillancourt et al. |
| 10,351,378 | B2 | 7/2019 | Marrano et al. |
| 10,744,801 | B2 | 8/2020 | Fernandez Guinea et al. |
| 2001/0028380 | A1 | 10/2001 | Wotton et al. |
| 2003/0142190 | A1 | 7/2003 | Rasmussen et al. |
| 2003/0179273 | A1 | 9/2003 | Tsuji et al. |
| 2007/0147936 | A1 | 6/2007 | Ando et al. |
| 2009/0046136 | A1 | 2/2009 | Choi et al. |
| 2019/0240999 | A1 | 8/2019 | Vaillancourt et al. |
| 2020/0079074 | A1 | 3/2020 | Fromm et al. |

APPARATUS TO FLATTEN A SUBSTRATE ALONG A PRINT PATH OF A PRINTER

CROSS-REFERENCE TO RELATED APPLICATIONS

This application claims priority to the U.S. provisional patent application Ser. No. 63/122,823 filed Dec. 8, 2020 which is incorporated herein by reference in its entirety.

TECHNICAL FIELD

The present application is related to printing, and more specifically to methods and systems that flatten the substrate along the print path.

BACKGROUND

During printing, when a substrate is placed on a transport belt, the edges of the substrate can lift from the transport belt. As a consequence, print quality near substrate edges can degrade, or the substrate can collide with the printheads. When printheads lower towards the transport belt to engage in printing, the printheads can press against the warped edges of the substrate causing friction between the printheads, the substrate, and the transport belt. To ease the friction, printers tend to increase the air gap between the substrate in the printheads to avoid a collision between the two. The friction can lead to transport belt elongation. The air gap can lead to print registration error. Print registration errors can be a costly problem and can occur when overlapping colors of a single image are out of alignment, resulting in an image that is blurry or fuzzy.

SUMMARY

Disclosed here is an apparatus to flatten the substrate as the substrate travels along the print path of a printer, thus reducing damage to the transport belt, motor, gearbox, etc., and increasing print quality. The apparatus includes two strapping metal bands mounted on the printer and parallel to the print path. The two strapping metal bands are under tension from a torsion spring and a ratchet placed at least at one end of the print path. In a rest position, the two strapping metal bands are lifted off the transport belt. When a printhead of the printer lowers to engage in printing, the printhead pushes on the two strapping metal bands causing them to push the edges of the substrate downward, thus increasing the flatness of the substrate.

BRIEF DESCRIPTION OF THE DRAWINGS

FIGS. 10A-10B show how to install the assembly-in.

DETAILED DESCRIPTION

An Apparatus to Flatten a Substrate Along a Print Path of a Printer

Disclosed here is an apparatus to flatten the substrate as the substrate travels along the print path of a printer, thus reducing damage to the transport belt, motor, gearbox, etc., and increasing print quality. The apparatus includes two strapping metal bands mounted on the printer and parallel to the print path. The two strapping metal bands are under tension from a torsion spring and a ratchet placed at least at one end of the print path. In a rest position, the two strapping metal bands are lifted off the transport belt. When a printhead of the printer lowers to engage in printing, the printhead pushes on the two strapping metal bands causing them to push the edges of the substrate downward, thus increasing the flatness of the substrate.

Figure 1:
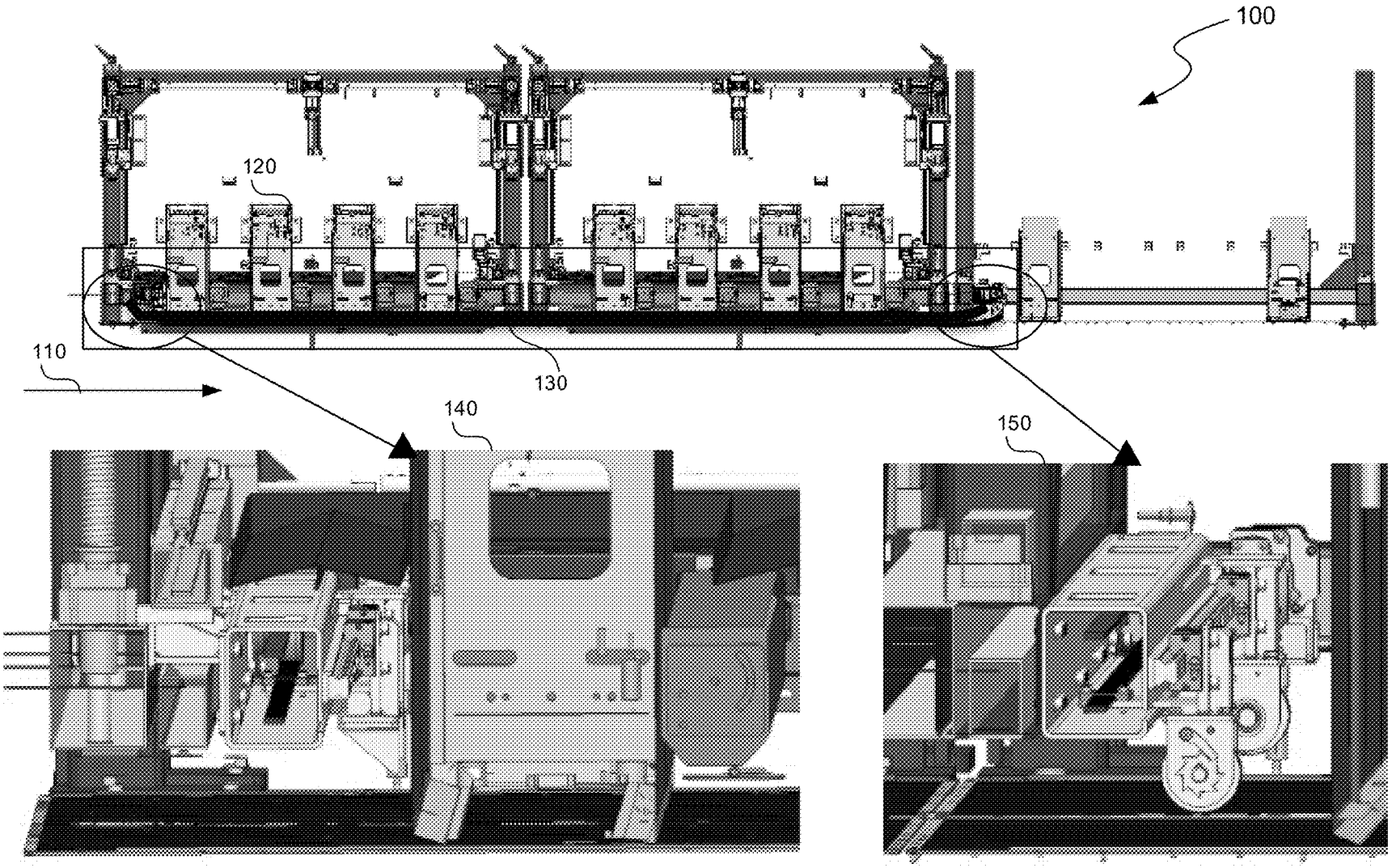
FIG. 1 shows a side view of a printer with the tensing system to hold down the edges of a substrate.

FIG. 1 shows a side view of a printer 100 with the tensing system to hold down edges of a substrate. The substrate 400 in FIGS. 4A-4C traverses the printer 100 along a direction of the print path 110 during printing. The substrate 400 can be paper, cardboard, textile, etc.

The tensing system is located under the one or more printheads 120 and includes an elongated resilient member 130, and an assembly-in mechanism 140, and an assembly-out mechanism 150 located at the two ends of the printer 100. The tensing system ensures the flatness of the substrate 400 during the printing process as the substrate 400 moves along a print path 110 of the printer 100.

The printheads 120, when printing on the substrate 400, lower towards the substrate 400 and pressure the elongated resilient member 130, which in turn pressures the substrate 400. The elongated resilient member 130 can be a strapping metal band or a plastic band. The elongated resilient member 130 is tensed by the combination of a biasing member, a ratchet mechanism, and the printheads 120. The biasing member can include a torsion spring or a regular spring. The lateral movement of the elongated resilient member 130 is managed by a pulley/belt system and motor, as explained in this application.

The printheads 120 can assume a first position proximate the substrate 400 when printing on the substrate 400. In the first position, the printhead 120 can be approximately 3 to 4 mm distant from the substrate 400. The printhead 120 can assume a second position removed from the substrate 400, when not engaged in printing. In the second position, the printhead 120 can be more than 50 million mm away from the substrate 400.

When the printhead 120 is in the first position, the printhead can tense the first elongated resilient member 130 by exerting vertical force or pressure on the first elongated resilient member, causing the first elongated resilient member to come into contact and exert pressure on the substrate 400. Due to the vertical force from the printhead 120, the elongated resilient member 130 can bend at regions 320, 330 (only two labeled for brevity) in FIG. 3.

Figure 2A:
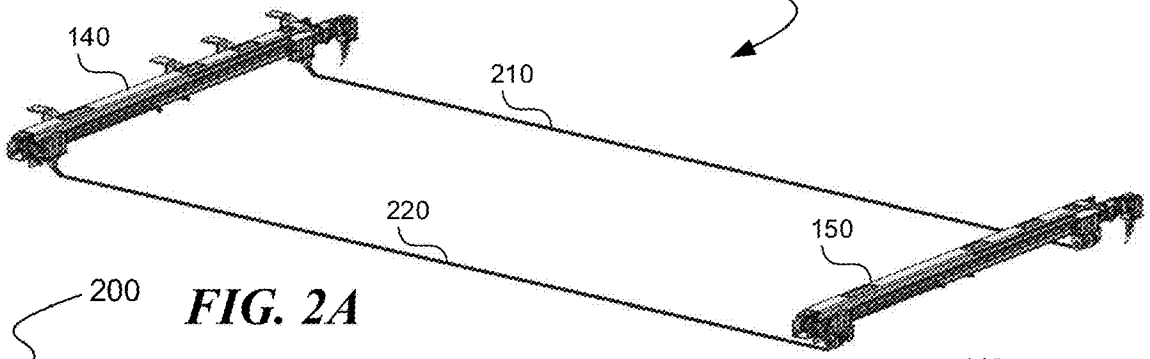
FIGS. 2A-2C show a tensing system from various points of view.
Figure 2B:
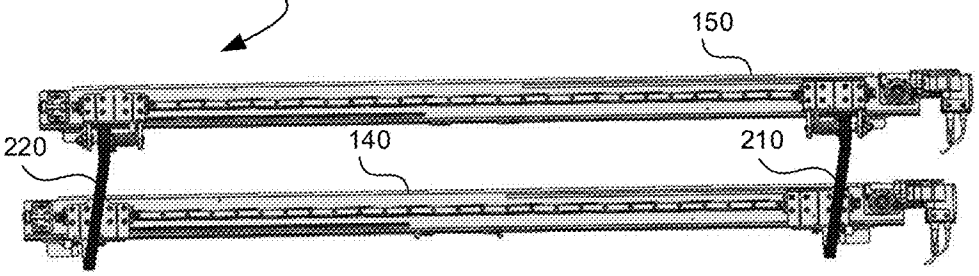
Figure 2C:
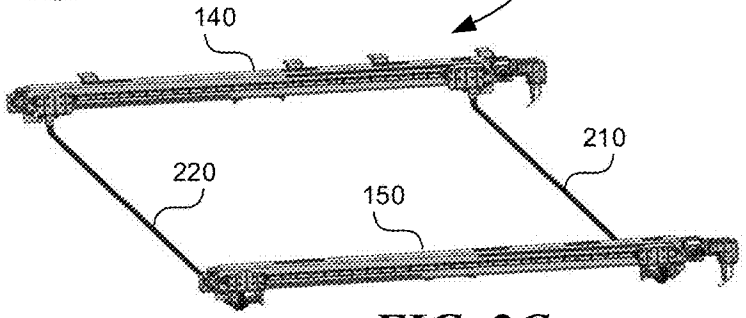

FIGS. 2A-2C show a tensing system 200 from various points of view. The two elongated resilient members 210, 220, one of which can be the elongated resilient member 130, can be positioned along a transport of the printer 100 in FIG. 1 and hold down two edges 402, 404 in FIG. 4 of a substrate 400 in FIG. 4. The two elongated resilient members 210, 220 are tensed by the assembly-in mechanism 140 and an assembly-out mechanism 150 containing a pulley-belt system and a motor.

Figure 3:
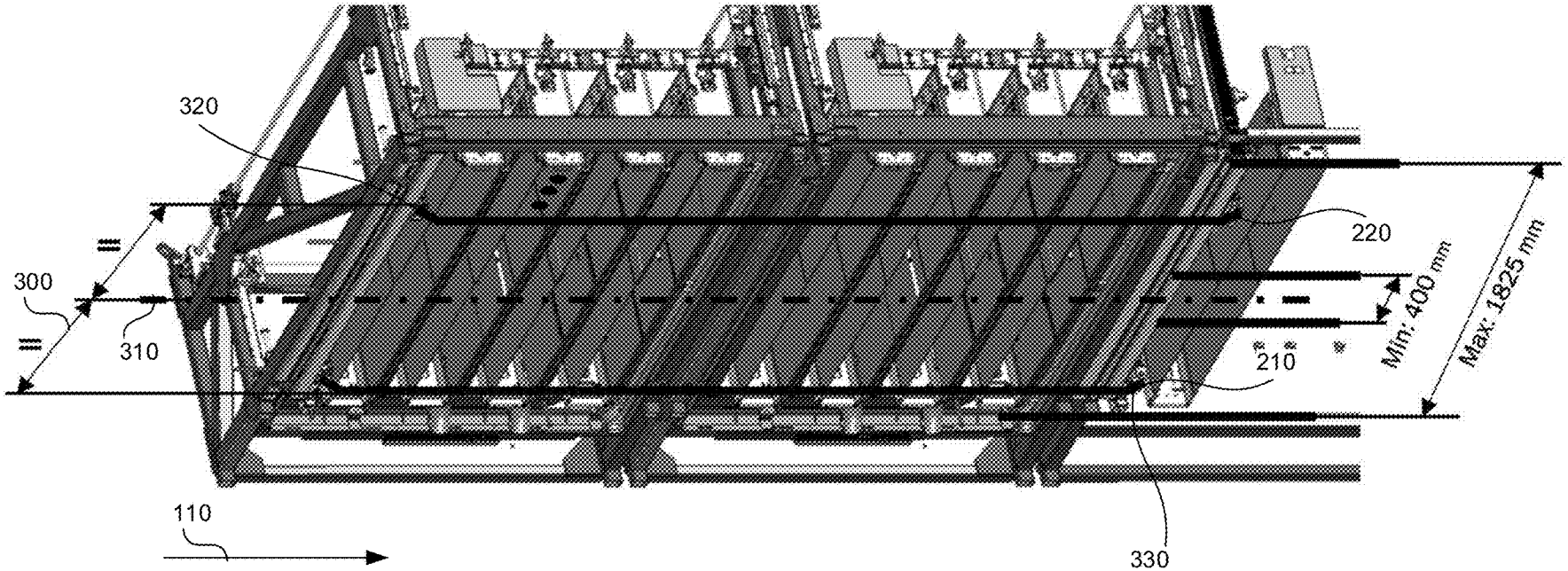
FIG. 3 shows an underside of the printheads and a tensing system.

FIG. 3 shows an underside of the printheads and a tensing system. The elongated resilient members 210, 220 can move in a transverse direction 300 relative to the print path 110 to accommodate substrates of various widths. The position of the elongated resilient members 210, 220 during the lateral movement is equidistant from the center 310 of the transport system. The elongated resilient members 210, 220 can accommodate substrate widths between 400 mm to 1825 mm, inclusive.

A printhead 120 associated with the printer 100 can include multiple nozzles 340, 350 (only three shown with two labeled for brevity) operable to deposit a print medium onto the substrate. The print medium can include ink or toner. When the printhead 120 lowers towards the substrate 400 in FIGS. 4A-4C, one or more of the nozzles 340, 350 among the multiple nozzles can come into contact with the elongated resilient member 210, 220 tensing the elongated resilient member. The elongated resilient member 210, 220 can bend in the regions 320, 330 (only two labeled for brevity), and come into contact with the substrate 400, exerting pressure on the substrate, and increasing the flatness of the substrate.

Figure 4A:
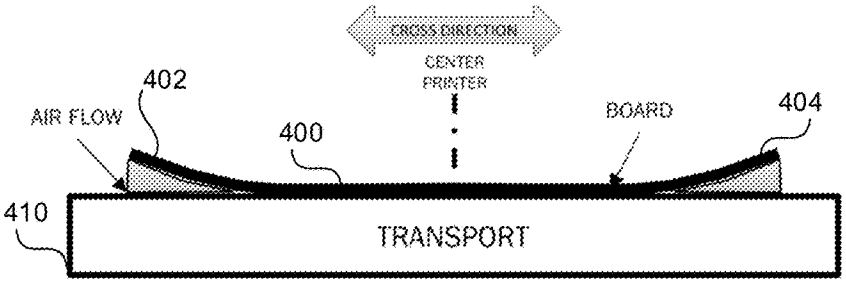
FIGS. 4A-4C show a cross-sectional view of a substrate, transport, and elongated resilient members.
Figure 4B:
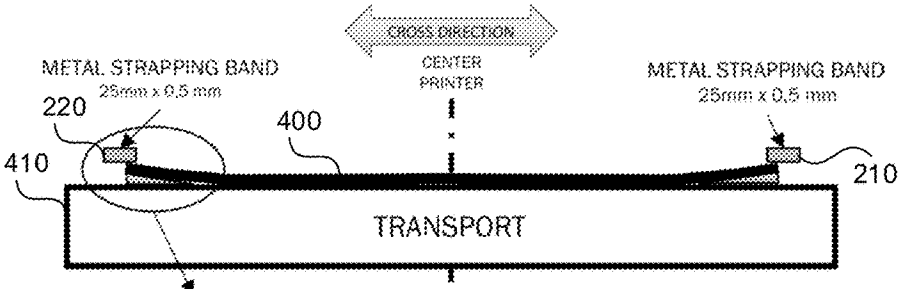
Figure 4C:
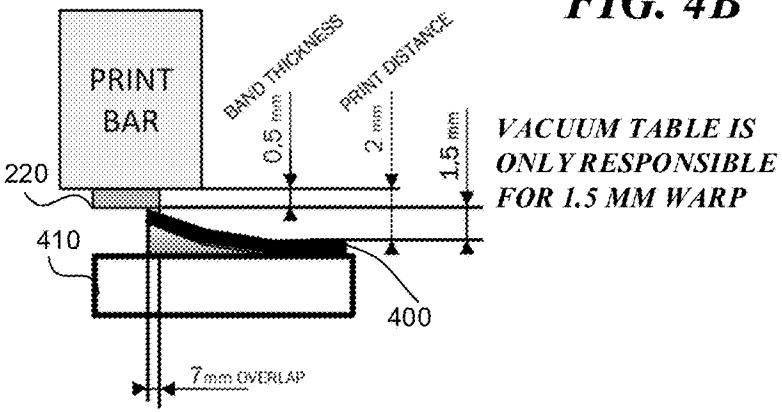

FIGS. 4A-4C show a cross-sectional view of a substrate, transport, and elongated resilient members. When substrate 400 is placed on the transport belt 410, the edges 402, 404 of the substrate can lift from the transport belt 410, as shown in FIG. 4A. As a consequence, print quality near substrate 400 edges 402, 404 can degrade because warped edges 402, 404 can lead to drop deflection. When printheads 120 in FIG. 1 lower towards the transport belt 410 to engage in printing, the printheads 120 can press against the warped edges 402, 404 of the substrate 400 causing friction between the printheads 120, the substrate 400, and the transport belt 410. The friction can lead to transport belt 410 elongation and print registration error. Print registration errors can be a costly problem and can occur when overlapping colors of a single image are out of alignment, resulting in an image that is blurry or fuzzy. Further, friction can lead to degradation of motor, gearbox, belt, etc.

As seen in FIGS. 4B-4C, the elongated resilient members 210, 220 can be in contact with the substrate 400 increasing the flatness of the substrate 400. As seen in FIG. 4B, the elongated resilient members 210, 220 can have a width of approximately 25 mm and a height of approximately 5 mm. The length of the elongated resilient members 210, 220 runs along the transport belt 410. When not in contact with the printheads 120, the elongated resilient members 210, 220 are positioned 50 mm away from the transport belt 410. When engaged with the printheads 120, the elongated resilient members 210, 220 are positioned 3-4 mm away from the transport belt 410.

As seen in FIG. 4C, the elongated resilient members 210, 220, when engaged with the substrate 400, can have a 7 mm overlap with the substrate 400. When the transport belt 410 includes a vacuum table, which pulls the substrate 400 towards the transport belt 410, the warp of the edges 402, 404 of the substrate 400 can be reduced to approximately 1.5 mm.

Figure 5A:
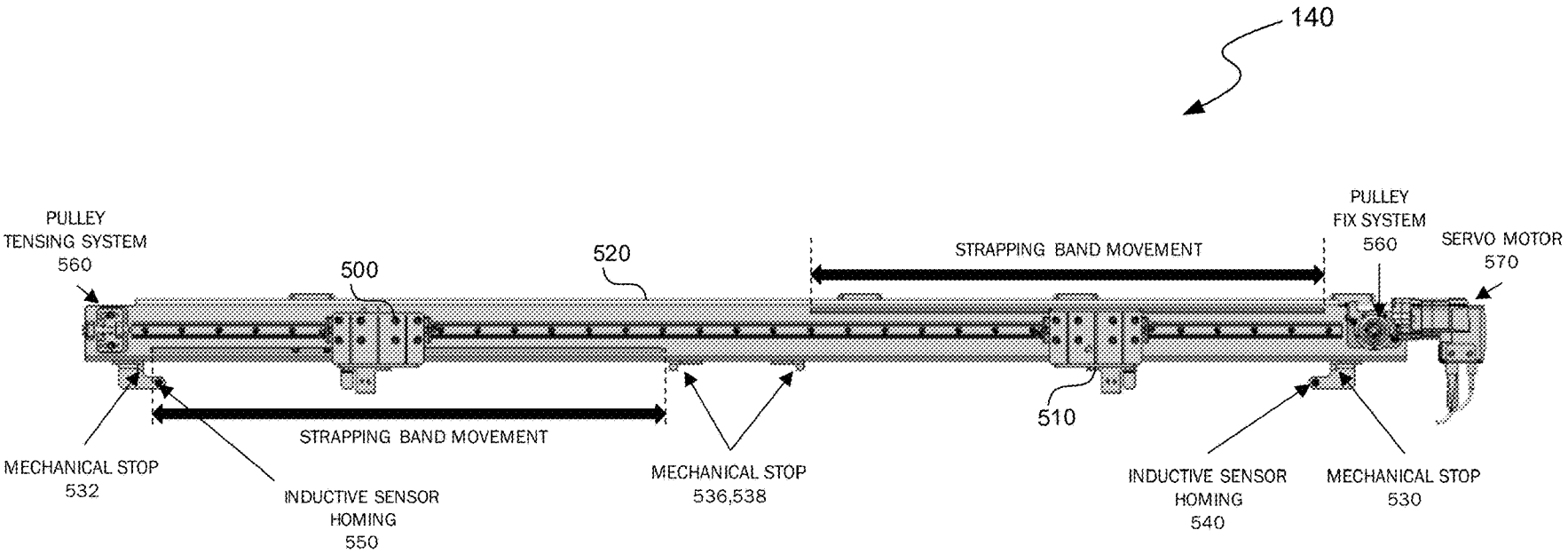
FIG. 5A shows a front view of the assembly-in mechanism.

FIG. 5A shows a front view of the assembly-in mechanism 140. The assembly-in mechanism 140 includes attachment ports 500, 510; a bar 520; mechanical stops 530, 532, 536, 538; an inductive sensor 540, 550; and a transverse motion mechanism. The transverse motion mechanism can include a pulley tensing system 560, a motor such as a servo motor 570, and a toothed belt 505 in FIG. 5C. A transverse motion mechanism can be operable to move the first attachment port and the second attachment port 500, 510 toward each other, and away from each other, thereby adjusting a distance between the first elongated resilient member and the second elongated resilient member 210, 220 in FIGS. 2A-2C.

Figure 8:
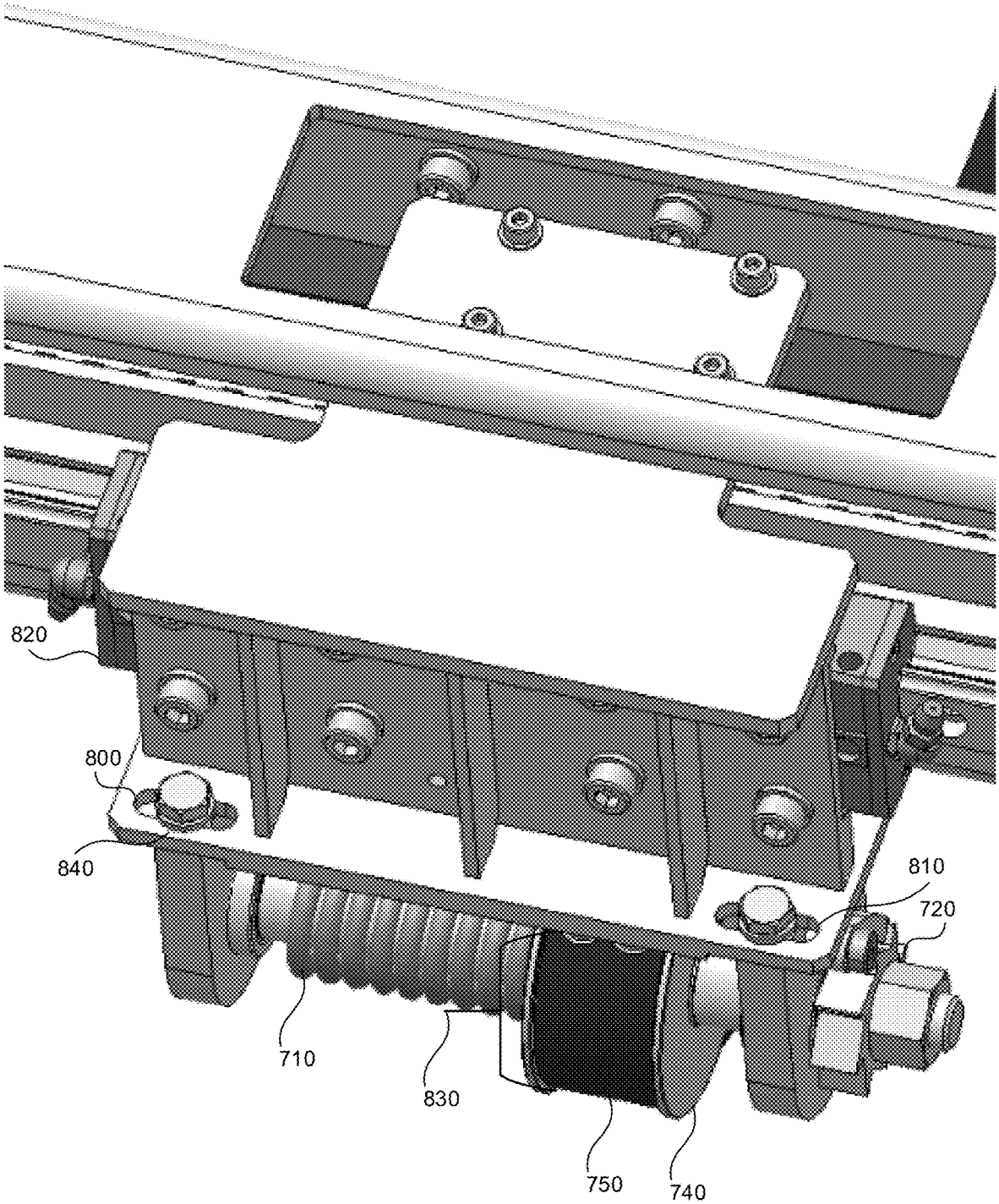
FIG. 8 shows a fine adjustment mechanism in the positioning of the elongated resilient member.

The attachment ports 500, 510 of the assembly-in mechanism 140 can connect to a terminal portion 830 in FIG. 8 of the elongated resilient member such as 210, 220 in FIGS. 2A-2C. The attachment ports 500, 510 can move along the length of the bar 520 positioned transversely to the direction of the print path 110 in FIG. 1. The mechanical stops 530, 532, 536, 538 serve to stop the movement of the attachment ports 500, 510 along the bar 520. The elongated resilient member 210, 220 can be attached to their respective attachment ports 500, 510 using an attachment mechanism such as a screw.

The inductive sensors 540, 550 are disposed at a terminal portion of the bar 520 and are operable to contactlessly detect the proximity of the attachment ports 500, 510 using electromagnetic induction. The inductive sensors 540, 550 are electrical components that can detect the position of the attachment ports 500, 510 without touching the attachment ports 500, 510. The inductive sensors 540, 550 use the principle of electromagnetic induction to detect or measure objects. An inductor develops a magnetic field when a current flows through it; alternatively, a current will flow through a circuit containing an inductor when the magnetic field through it changes. This effect can be used to detect metallic objects that interact with a magnetic field. Non-metallic substances such as liquids or some kinds of dirt do not interact with the magnetic field, so an inductive sensor can operate in wet or dirty conditions. Consequently, the attachment ports 500, 510 are made from a metallic material. The inductive sensors 540, 550 can detect the attachment ports 500, 510 when the attachment ports are at the maximum print width position, such as 1825 mm.

The servo motor 570 can define a zero-position of the attachment port 510, 500 as a position where the inductive sensor 540, 550 detects the attachment port 510, 500, respectively. The zero-position of the attachment port 510, 500 can represent the widest distance between the attachment ports 500, 510, accommodating a substrate width of 1825 mm as explained in FIG. 3. When the printer 100 in FIG. 1 receives a narrower substrate, a processor of the printer 100 can specify a new position to the servo motor 570, which is measured relative to the zero-position. For example, the new position can be 500 mm, indicating that the attachment port 510, 500 should move 500 mm away from the zero-position.

Figure 5B:
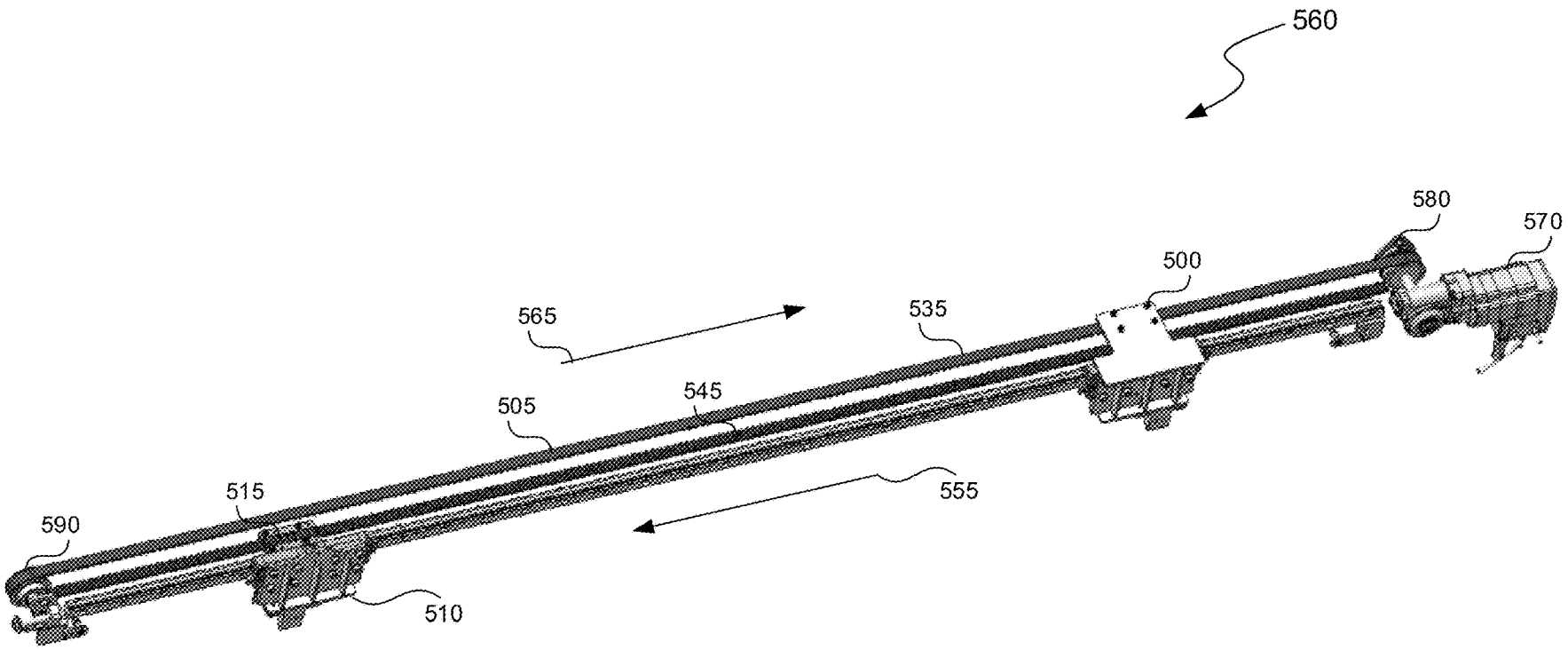
FIG. 5B shows the pulley tensing system.

The servo motor 570 can enable movement of the attachment ports 500, 510 along the bar 520 by, for example, causing the pulley 580 in FIG. 5B closest to the servo motor 570 to rotate. In response, the toothed belt 505 in FIG. 5B rotates, causing the pulley 590 in FIG. 5B to rotate and move the attachment ports 500, 510 toward or away from each other.

FIG. 5B shows the pulley tensing system 560. The pulley tensing system includes two pulleys 580, 590, and a belt such as a toothed belt 505 looping around the two pulleys 580, 590. The attachment ports 500, 510 are mounted on the toothed belt 505. A toothed belt 505 is a flexible belt with teeth molded onto its inside surface. The inside surface runs over the pulleys 580, 590. The pulleys 580, 590 can have matching sprockets or apertures to fill in the gaps in the toothed belt 505. The attachment ports 500, 510 can have apertures, or sprockets 515 (only one labeled for brevity) that can wedge between the teeth of the toothed belt 505 when the attachment ports 500, 510 are stationary.

The attachment port 500 is mounted on a top portion 535 of the toothed belt 505, while the attachment port 510 is mounted on a bottom portion 545 of the toothed belt 505. The servo motor 570 can move the toothed belt 505 in the direction 555, which causes the attachment ports 500, 510 to move toward each other. Consequently, when the attachment ports 500, 510 are closer together, the printer 100 in FIG. 1 can accommodate the substrate of a smaller width. The servo motor can also move the toothed belt 505 in the direction 565, which causes the attachment ports 500, 510 to move away from each other. Consequently, when the attachment ports 500, 510 are farther apart, and printer 100 in FIG. 1 can accommodate the substrate of a larger width.

Figure 5C:
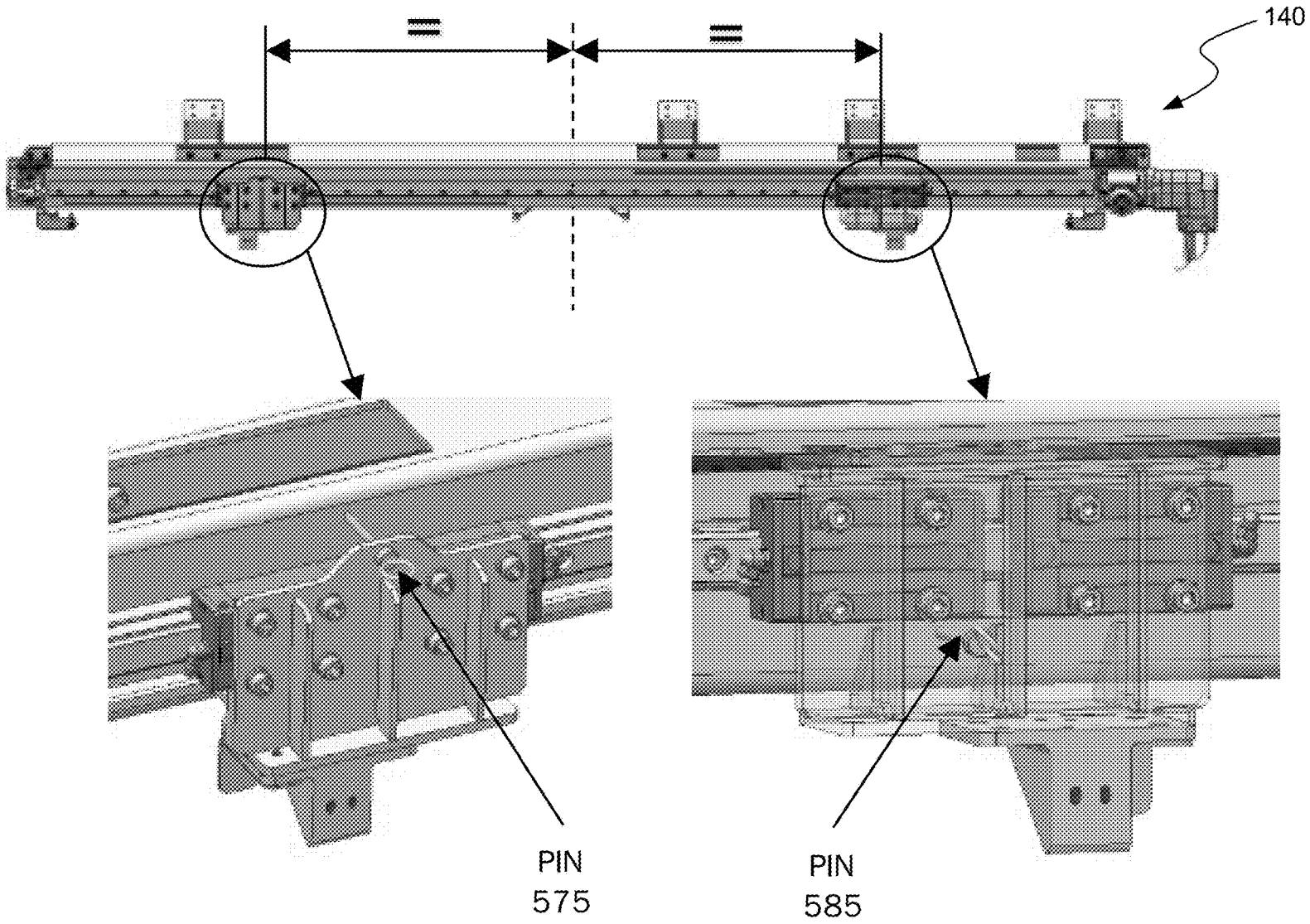
FIG. 5C shows how the attachment ports of an assembly-in mechanism are mounted to the bar.

FIG. 5C shows how the attachment ports 500, 510 of the assembly-in mechanism 140 are mounted to the bar 520. The attachment ports 500, 510 are equidistant from the center 595 of the bar 520. The pins 575, 585 secure the attachment ports 500, 510, respectively, to the bar 520. As can be seen in FIG. 5C, the pin 575 is mounted at the top of the attachment port 500, because the attachment port 500 attaches to the bottom portion 545 of the toothed belt 505 in FIG. 5B. The pin 585 is mounted at the bottom of the attachment port 510 because the attachment port 510 attaches to the top portion 535 of the toothed belt 505 in FIG. 5B. Consequently, there is a slight vertical offset in the positions of the attachment port 500 and 510.

Figure 6:
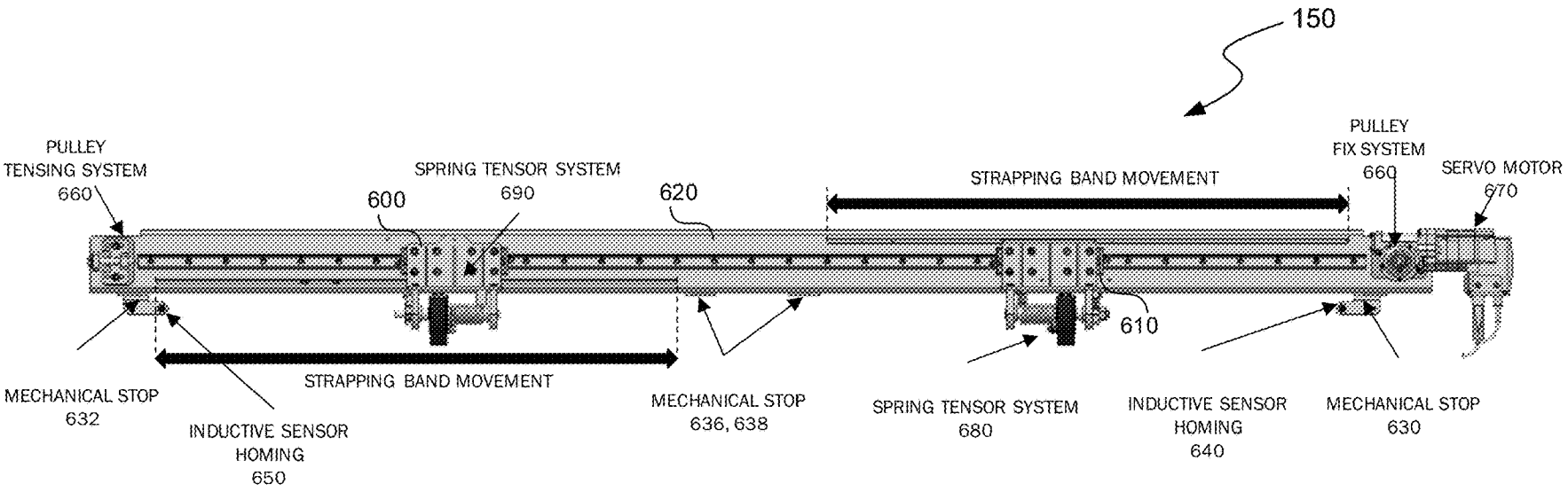
FIG. 6 shows a front view of the assembly-out mechanism.

FIG. 6 shows a front view of the assembly-out mechanism 150. The assembly-out mechanism 150 includes attachment ports 600, 610; a bar 620; mechanical stops 630, 632, 636, 638; an inductive sensor 640, 650; and a transverse motion mechanism. The transverse motion mechanism can include a pulley tensing system 660, a motor such as a servo motor 670, and a toothed belt (not shown). A transverse motion mechanism can be operable to move the first attachment port and the second attachment port 600, 610 toward each other, and away from each other, thereby adjusting a distance between the first elongated resilient member and the second elongated resilient member 210, 220 in FIGS. 2A-2C.

The above-listed parts of the assembly-out mechanism 150 serve the same functions as their corresponding namesake parts in the assembly-in mechanism 140 shown in FIG. 5A. In addition, the assembly-out mechanism 150 includes the spring tensor system 680, 690.

The attachment port 600 and the corresponding attachment port 500 in FIG. 5A support one elongated resilient member (e.g., 220) in FIGS. 2A-2C. The attachment port 610 and the corresponding attachment port 510 in FIG. 5A support one elongated resilient member (e.g., 210) in FIGS. 2A-2C. The elongated resilient members 210 and 220 are substantially parallel to each other, +/−5°. That means that the location of the attachment port 500 on the bar 520 in FIG. 5A is the same as the location of the attachment port 600 on the bar 620. Similarly, the location of the attachment port 510 in FIG. 5A on the bar 520 in FIG. 5A is the same as the location of the attachment port 610 on the bar 620.

Figure 7A:
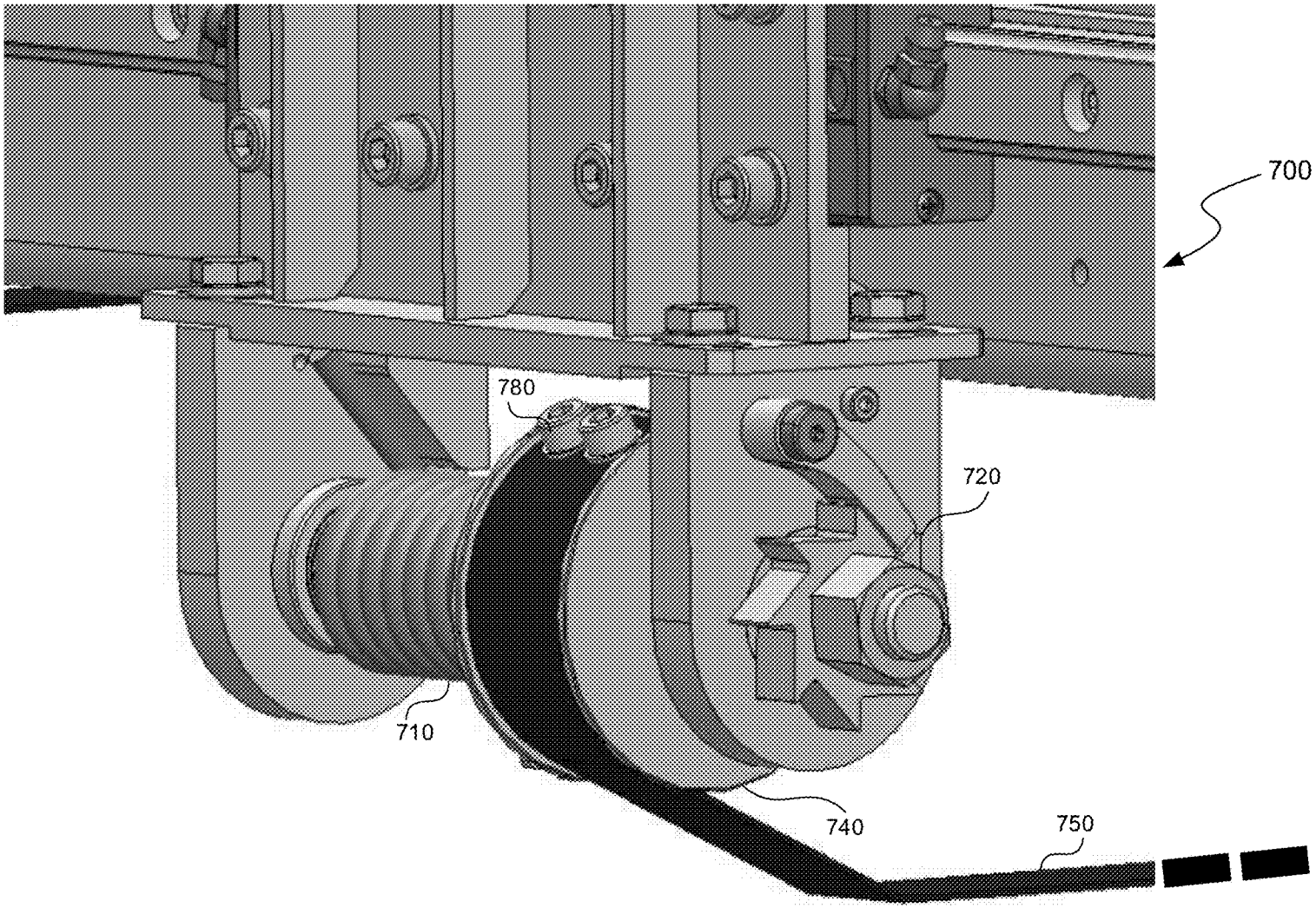
FIGS. 7A-7C show the side, back, and a cross-sectional view, respectively, of the spring tensor system.
Figure 7B:
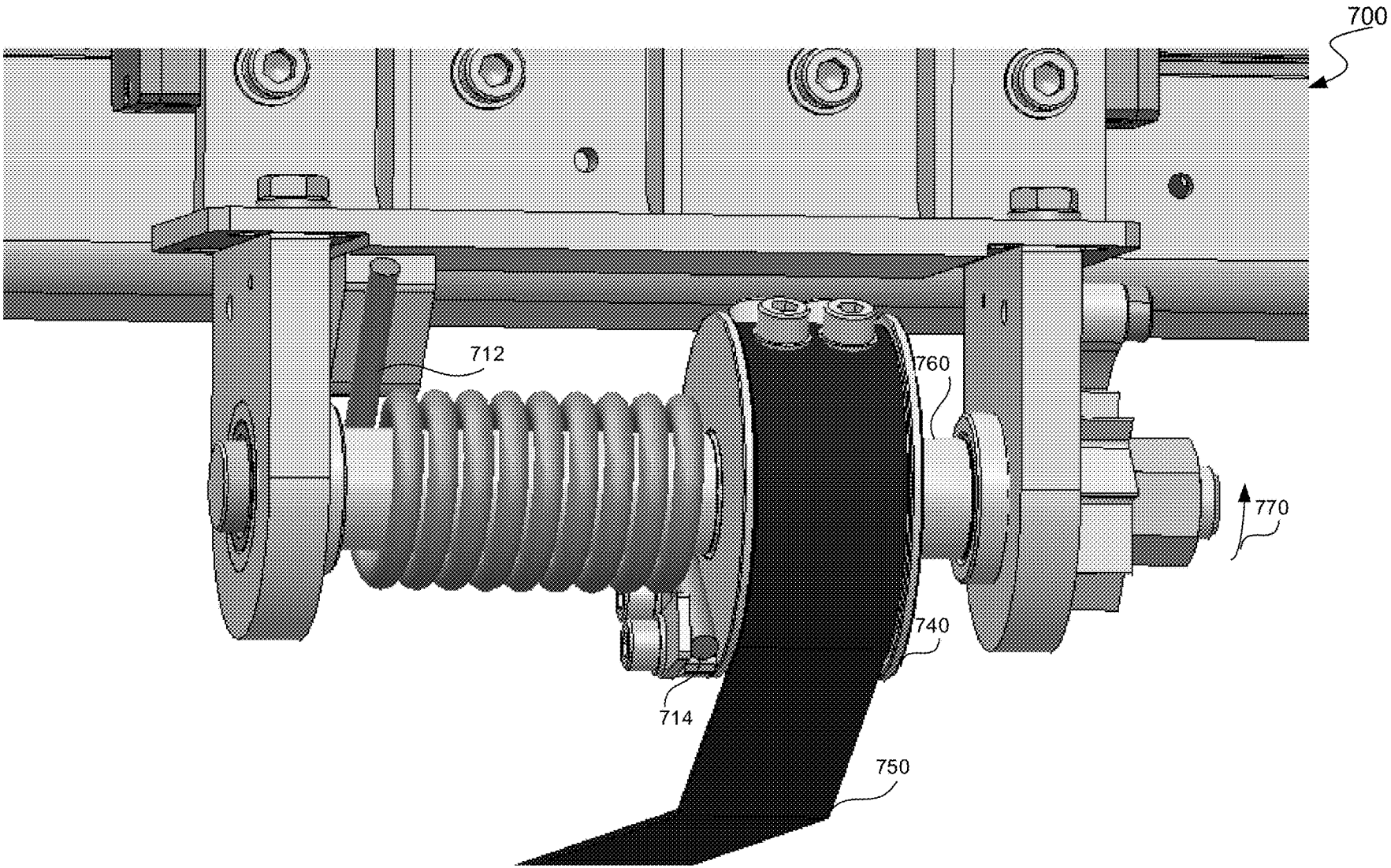
Figure 7C:
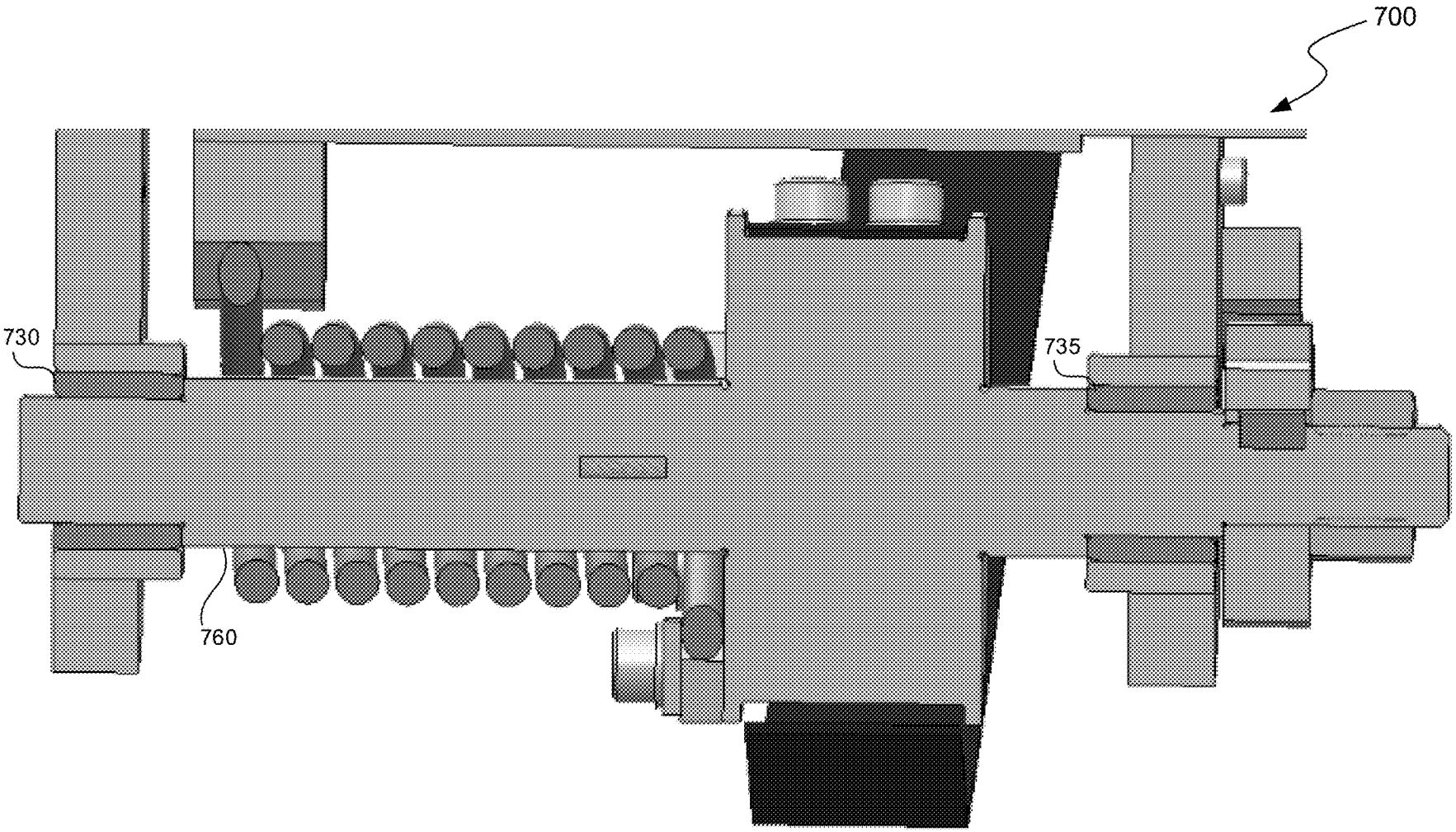

FIGS. 7A-7C show the side, back, and a cross-sectional view, respectively, of the spring tensor system 680, 690 in FIG. 6. The spring tensor system 700 associated with the assembly-out mechanism 150 is part of the tensing system 200 in FIG. 2. The spring tensor system 700 can include a biasing member 710, a ratchet 720, and a capstan 740. The biasing member 710 can be a torsion spring or a regular spring. The biasing member 710 can apply rotational force to the capstan 740. The capstan 740 can be in connection with the biasing member 710 through a load branch spring 714 in FIG. 7B. The rotation of the capstan 740 in a first direction 770 in FIG. 7C applies tension to the elongated resilient member 750. Consequently, the elongated resilient member 750 correspondingly applies pressure to a substrate 400 in FIGS. 4A-4C as the substrate is moved along the print path 110 in FIG. 1.

The ratchet 720 can pre-load the torsion spring 710 and enable attachment of the elongated resilient member 750 on the capstan 740. The elongated resilient member 750, can be one of the elongated resilient members 210, 220 shown, for example, in FIGS. 2A-2C. The attachment mechanism 780 securing the elongated resilient member 750 to the capstan 740 can include one or more screws. The tightness of the elongated member 750 can be adjusted by the rotation of the capstan 740 and ratchet 720.

For example, an operator, such as a robot operator, installing the assembly-out mechanism 150, can tighten or loosen the elongated member 750 depending on how far above a substrate 400 in FIGS. 4A-4C the elongated member 750 is. In a more specific example, if the elongated member 750 is touching the transport belt, when the elongated member 750 is not in contact with the printhead 120 in FIG. 1, the operator can tighten the elongated member 750 by spooling the elongated member 750 around the capstan 740. The operator can adjust the ratchet position to support the spooling of the elongated member 750 around the capstan 740. If the elongated member 750 does not come into contact with the substrate 400 when the printheads 120 are lowered, the operator can loosen the elongated member 750 by adjusting the ratchet 720 to allow unwinding of the elongated member from the capstan 740.

The torsion spring 710 can include a fixed branch spring 712 and a load branch spring 714. The load branch spring 714 can move as the capstan 740 rotates, while the fixed branch spring 712 stays motionless as the capstan 740 rotates. Rotation of the capstan in the direction 770 tightens the elongated resilient member 750. The two guides bush 730, 735 are auto lubricated and allow rotation of the axle 760 without friction. The capstan 740 can rotate around the axle 760, or the capstan and the axle can rotate together as shown in FIG. 7C.

FIG. 8 shows a fine adjustment mechanism in the positioning of the elongated resilient member 750. To ensure parallelism between the two elongated resilient members 210, 220, the attachment port 500, 510 in FIG. 5A and 600, 610 in FIG. 6 can form oblong apertures 800, 810 for the fine adjustment. The spring tensor system 680, 690 in FIG. 6 including a torsion spring 710, a ratchet 720, and a capstan 740 can be positioned to the left or the right, along the direction of the apertures 800, 810. The width of the apertures 800, 810 can be approximately up to 1 cm and can allow sideways adjustment of the spring tensor system 680, 690, and consequently the sideways adjustment of one end of the elongated resilient member 210, 220.

The first oblong aperture 800 formed by the attachment port 820 can enable coupling of the first terminal portion 830 of the first elongated resilient member 750 to the attachment port 820 through the use of a screw 840. The first oblong aperture 800 can enable movement of the first terminal portion 830 of the first elongated resilient member 750 transverse to the print path 110 in FIG. 1. The movement of the first terminal portion 830 of the first elongated resilient member 750 can enable a parallel alignment of the first elongated resilient member 750 and the print path 110.

Figure 9A:
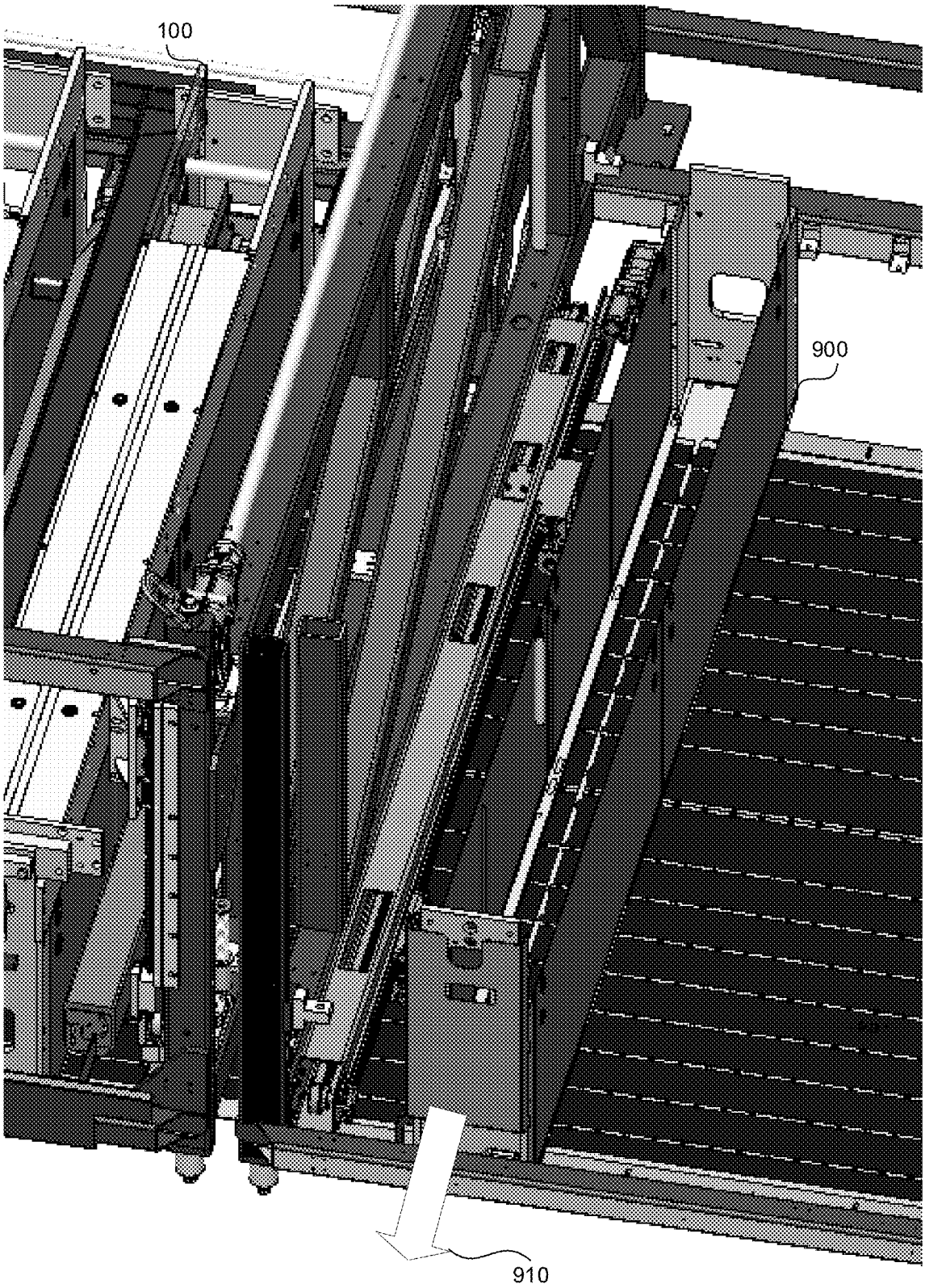
FIGS. 9A-9B show how to install the assembly-out.
Figure 9B:
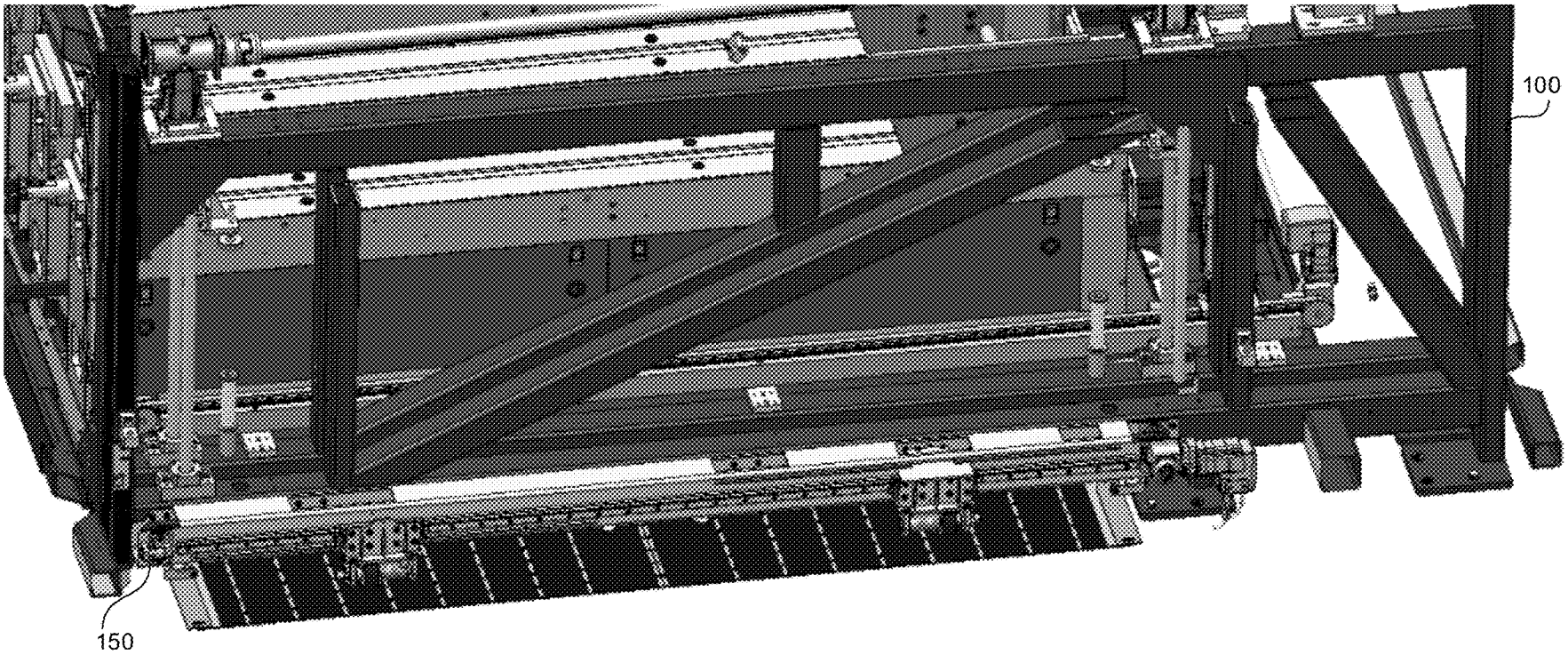

FIGS. 9A-9B show how to install an assembly-out mechanism 150. An operator, such as a robot operator, can enter into the printer 100 and pull out the LED 900 bar in the direction 910. With an electric drill and a holes template, the operator can drill and thread to mount the assembly-out mechanism 150 as shown in FIG. 9B. The assembly-out mechanism 150 can weigh up to 35 kg.

Figure 10A:
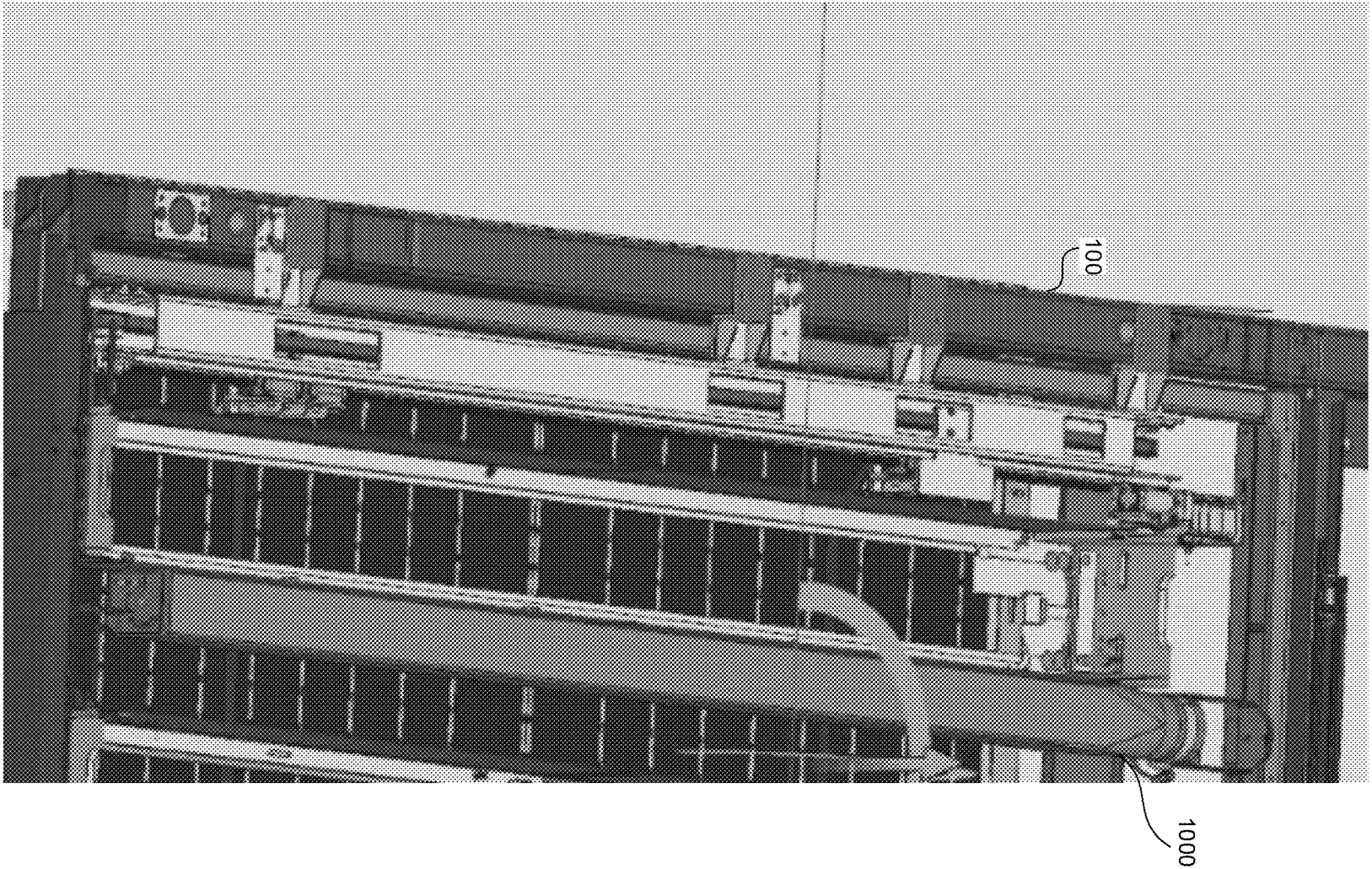
Figure 10B:
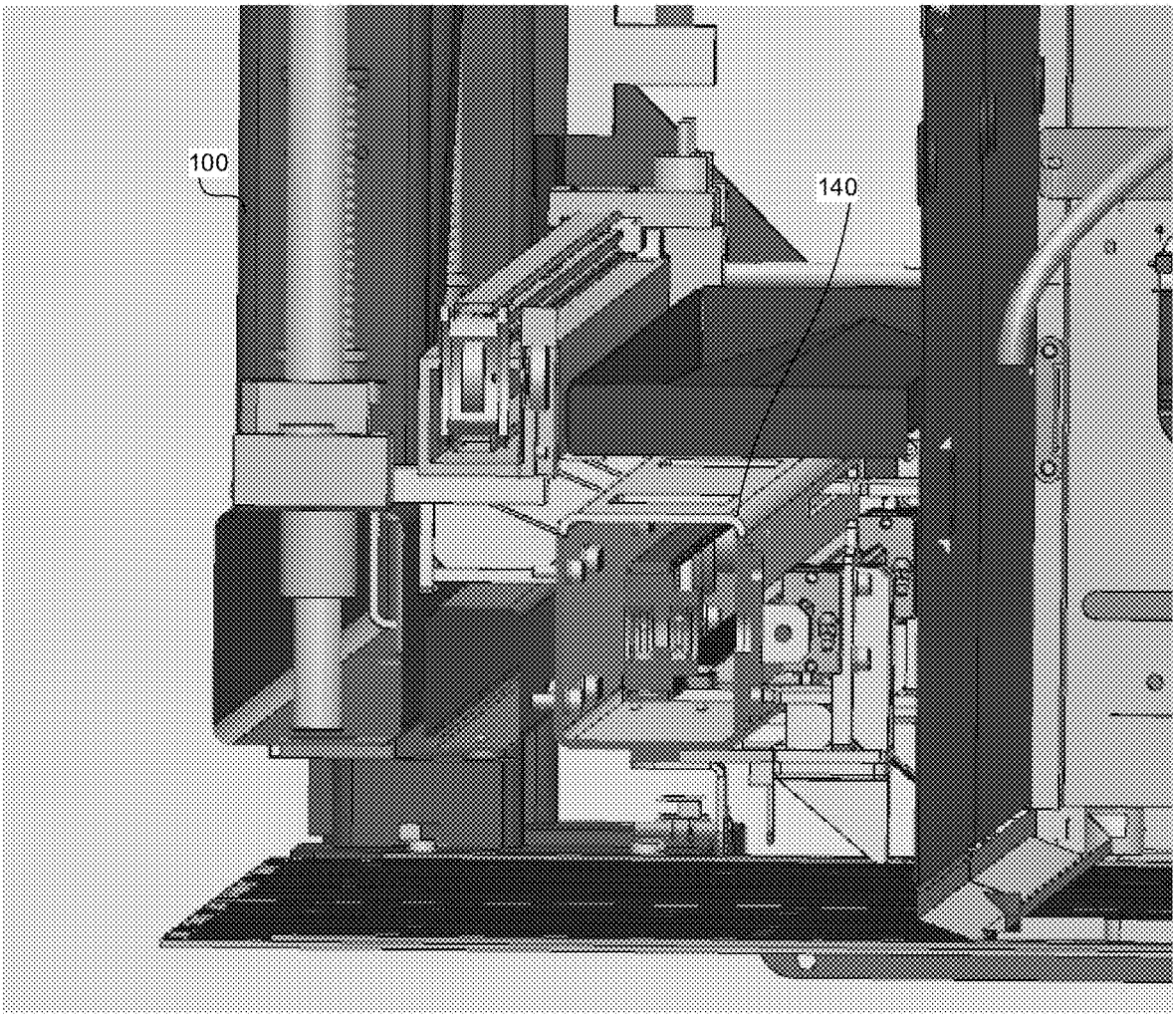

FIGS. 10A-10B show how to install an assembly-in mechanism 140. An operator, such as a robot operator, can enter into the printer 100 and pull out the printbars 1000 (only one shown for brevity). The operator can take out printer covers, and take out product detect. Product detect is a sensor that can detect the presence of a substrate and can trigger the beginning of the printing process by indicating to the printheads to start printing. With an electric drill and a holes templates, the operator can drill and thread to mount the assembly-in mechanism 140 as shown in FIG. 10 B. The assembly-in mechanism 140 can weigh up to 35 kg.

Figure 11:
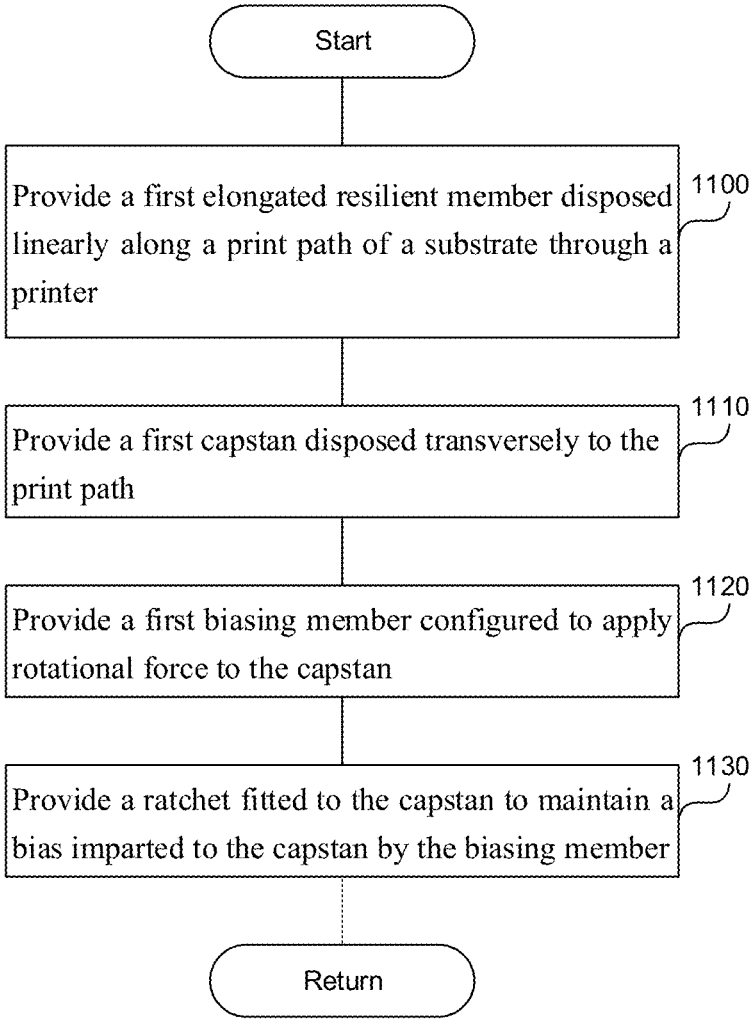
FIG. 11 is a flowchart of a method to flatten a substrate along a print path of a printer.

FIG. 11 is a flowchart of a method to flatten a substrate along a print path of a printer. In step 1100, a first elongated resilient member disposed linearly along a print path of a substrate through a printer is provided. In step 1110, a first capstan disposed transversely to the print path is provided. A first terminal portion of the elongated resilient member can be secured to the capstan.

In step 1120, a first biasing member is provided. The first biasing member can be configured to apply rotational force to the capstan. The rotation of the capstan in connection with the biasing member in a first direction can apply tension to the elongated resilient member. In response, the elongated resilient member can apply pressure to a substrate as the substrate is moved along the print path by the printer. The pressure applied by the elongated resilient member can increase the flatness of the substrate.

In step 1130, a ratchet fitted to the capstan is provided. The ratchet can maintain a bias imparted to the capstan by the biasing member by securing the capstan against rotation in a direction that would release the bias.

A distance between the first elongated resilient member and a transport belt associated with the printer can be adjusted. The transport belt can carry the substrate along the print path. To adjust the distance between the first elongated resilient member and the transport belt, tension can be increased in the first elongated resilient member by winding the ratchet. The distance can be adjusted automatically or using an operator, such as a robot.

Hardware or software processor associated with the printer executing instructions describing this application can determine a nozzle in a plurality of nozzles associated with a printhead exerting pressure on the first elongated resilient member, wherein the nozzle in the plurality of nozzles exerts vertical pressure on the first elongated resilient member. The processor can turn off the nozzle when the printhead is engaged in printing.

The processor can adjust the position of an attachment port supporting the first elongated resilient member. The attachment port is configured to move transversely to the print path and in line with an inductive sensor. The processor can calibrate a zero-position of an attachment port supporting the first elongated resilient member when the inductive sensor associated with the printer detects a proximity of the first attachment port. The processor can calculate the position of the first attachment port with respect to the zero-position and can cause the attachment port to move to the position.

Computer

Figure 12:
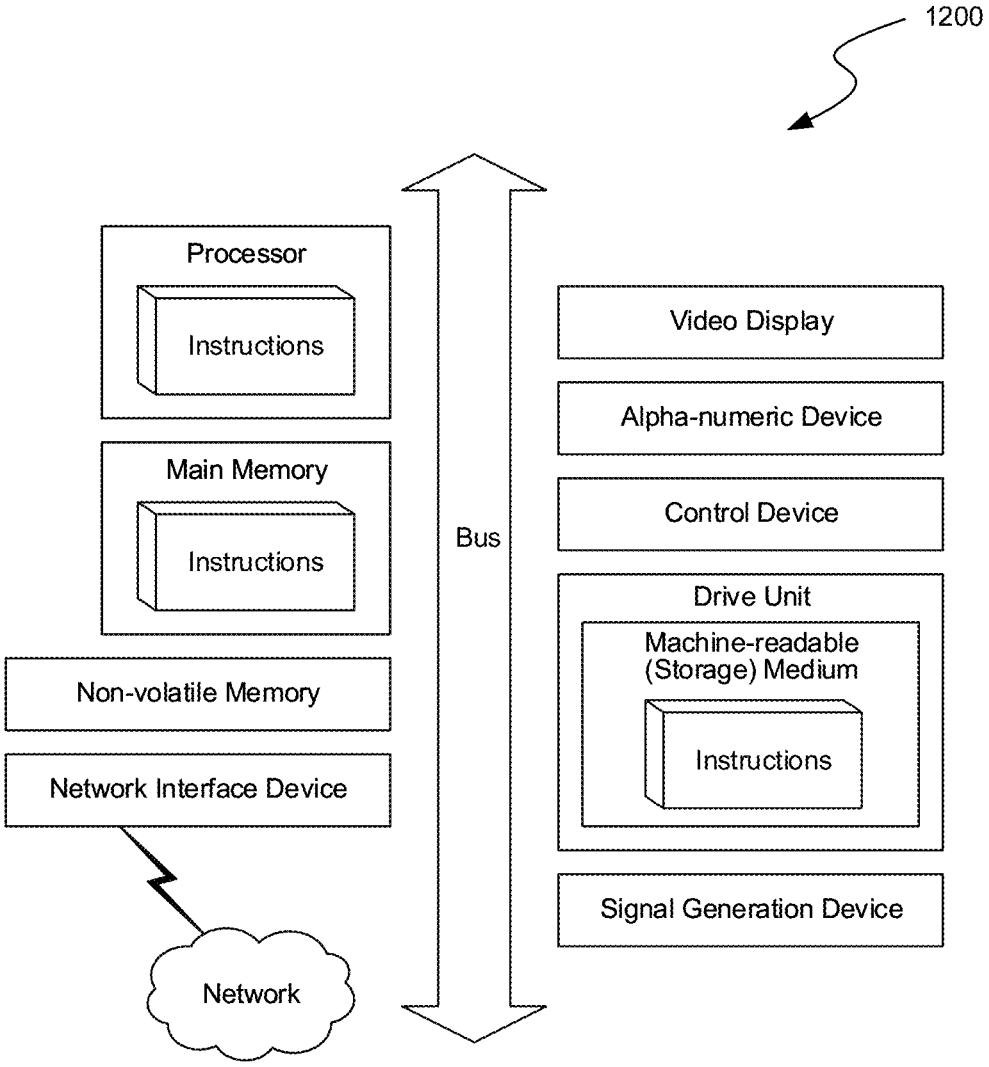
FIG. 12 is a diagrammatic representation of a machine in the example form of a computer system within which a set of instructions, for causing the machine to perform any one or more of the methodologies or modules discussed herein, may be executed.

FIG. 12 is a diagrammatic representation of a machine in the example form of a computer system 1200 within which a set of instructions, for causing the machine to perform any one or more of the methodologies or modules discussed herein, may be executed.

In the example of FIG. 12, the computer system 1200 includes a processor, memory, non-volatile memory, and an interface device. Various common components (e.g., cache memory) are omitted for illustrative simplicity. The computer system 1200 is intended to illustrate a hardware device on which any of the components described in the example of FIGS. 1-11 (and any other components described in this specification) can be implemented. The computer system 1200 can be of any applicable known or convenient type. The components of the computer system 1200 can be coupled together via a bus or through some other known or convenient device.

The processor of the computer system 1200 can be associated with the printer 100 in, for example, FIG. 1. The processor can include a subroutine to communicate with the servo motor 570 in FIG. 5A, 670 FIG. 6 and to communicate with the inductive sensor 540, 550 in FIG. 5A, 640, 650 in FIG. 6. The processor can calibrate the zero-position of the attachment ports 500, 510 in FIG. 5A, and 600, 610 in FIG. 6. In addition, as the position of the attachment ports 500, 510, 600, 610 varies along the bar 520 in FIG. 5A, 620 in FIG. 6, to adjust for the width of the substrate 400 in FIG. 4A-4C, the processor can disable the one or more nozzles of the printheads 120 in FIG. 1; that is pressuring the elongated resilient member 210, 220 in, for example, FIGS. 2A-2C.

The main memory, the nonvolatile memory, and/or the drive unit of the computer system 1200 can store the instructions executed by the processor, and described in this application. The network of the computer system 1200 can be used to receive updates to the instructions executed by the processor, such as additions to the subroutine. Further, the network of the computer system 1200 can be used to receive information about printing patterns.

This disclosure contemplates the computer system 1200 taking any suitable physical form. As an example and not by way of limitation, computer system 1200 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, or a combination of two or more of these. Where appropriate, computer system 1200 may include one or more computer systems 1200; be unitary or distributed; span multiple locations; span multiple machines; or reside in a cloud, which may include one or more cloud components in one or more networks. Where appropriate, one or more computer systems 1200 may perform without substantial spatial or temporal limitation one or more steps of one or more methods described or illustrated herein. As an example and not by way of limitation, one or more computer systems 1200 may perform in real time or in batch mode one or more steps of one or more methods described or illustrated herein. One or more computer systems 1200 may perform at different times or at different locations one or more steps of one or more methods described or illustrated herein, where appropriate.

The processor may be, for example, a conventional microprocessor such as an Intel Pentium microprocessor or Motorola power PC microprocessor. One of skill in the relevant art will recognize that the terms "machine-readable (storage) medium" or "computer-readable (storage) medium" include any type of device that is accessible by the processor.

The memory is coupled to the processor by, for example, a bus. The memory can include, by way of example but not limitation, random access memory (RAM), such as dynamic RAM (DRAM) and static RAM (SRAM). The memory can be local, remote, or distributed.

The bus also couples the processor to the non-volatile memory and drive unit. The non-volatile memory is often a magnetic floppy or hard disk, a magnetic-optical disk, an optical disk, a read-only memory (ROM), such as a CD-ROM, EPROM, or EEPROM, a magnetic or optical card, or another form of storage for large amounts of data. Some of this data is often written, by a direct memory access process, into memory during execution of software in the computer 1200. The non-volatile storage can be local, remote, or distributed. The non-volatile memory is optional because systems can be created with all applicable data available in memory. A typical computer system will usually include at least a processor, memory, and a device (e.g., a bus) coupling the memory to the processor.

Software is typically stored in the non-volatile memory and/or the drive unit. Indeed, storing an entire large program in memory may not even be possible. Nevertheless, it should be understood that for software to run, if necessary, it is moved to a computer-readable location appropriate for processing, and for illustrative purposes, that location is referred to as the memory in this application. Even when software is moved to the memory for execution, the processor will typically make use of hardware registers to store values associated with the software, and local cache that, ideally, serves to speed up execution. As used herein, a software program is assumed to be stored at any known or convenient location (from non-volatile storage to hardware registers) when the software program is referred to as "implemented in a computer-readable medium." A processor is considered to be "configured to execute a program" when at least one value associated with the program is stored in a register readable by the processor.

The bus also couples the processor to the network interface device. The interface can include one or more of a modem or network interface. It will be appreciated that a modem or network interface can be considered to be part of the computer system 1200. The interface can include an analog modem, ISDN modem, cable modem, token ring interface, satellite transmission interface (e.g. "direct PC"), or other interfaces for coupling a computer system to other computer systems. The interface can include one or more input and/or output devices. The I/O devices can include, by way of example but not limitation, a keyboard, a mouse or other pointing device, disk drives, printers, a scanner, and other input and/or output devices, including a display device. The display device can include, by way of example but not limitation, a cathode ray tube (CRT), liquid crystal display (LCD), or some other applicable known or convenient display device. For simplicity, it is assumed that controllers of any devices not depicted in the example of FIG. 12 reside in the interface.

In operation, the computer system 1200 can be controlled by operating system software that includes a file management system, such as a disk operating system. One example of operating system software with associated file management system software is the family of operating systems known as Windows® from Microsoft Corporation of Redmond, Wash., and its associated file management systems. Another example of operating system software with its associated file management system software is the Linux™ operating system and its associated file management system. The file management system is typically stored in the non-volatile memory and/or drive unit and causes the processor to execute the various acts required by the operating system to input and output data and to store data in the memory, including storing files on the non-volatile memory and/or drive unit.

Some portions of the Detailed Description may be presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of operations leading to a desired result. The operations are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or "generating" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The algorithms and displays presented herein are not inherently related to any particular computer or other apparatus. Various general purpose systems may be used with programs in accordance with the teachings herein, or it may prove convenient to construct more specialized apparatus to perform the methods of some embodiments. The required structure for a variety of these systems will appear from the description below. In addition, the techniques are not described with reference to any particular programming language, and various embodiments may thus be implemented using a variety of programming languages.

In alternative embodiments, the machine operates as a standalone device or may be connected (e.g., networked) to other machines. In a networked deployment, the machine may operate in the capacity of a server or a client machine in a client-server network environment, or as a peer machine in a peer-to-peer (or distributed) network environment.

The machine may be a server computer, a client computer, a personal computer (PC), a tablet PC, a laptop computer, a set-top box (STB), a personal digital assistant (PDA), a cellular telephone, an iPhone, a Blackberry, a processor, a telephone, a web appliance, a network router, switch or bridge, or any machine capable of executing a set of instructions (sequential or otherwise) that specify actions to be taken by that machine.

While the machine-readable medium or machine-readable storage medium is shown in an exemplary embodiment to be a single medium, the term "machine-readable medium" and "machine-readable storage medium" should be taken to include a single medium or multiple media (e.g., a centralized or distributed database, and/or associated caches and servers) that store the one or more sets of instructions. The term "machine-readable medium" and "machine-readable storage medium" shall also be taken to include any medium that is capable of storing, encoding or carrying a set of instructions for execution by the machine and that cause the machine to perform any one or more of the methodologies or modules of the presently disclosed technique and innovation.

In general, the routines executed to implement the embodiments of the disclosure, may be implemented as part of an operating system or a specific application, component, program, object, module or sequence of instructions referred to as "computer programs." The computer programs typically comprise one or more instructions set at various times in various memory and storage devices in a computer, and that, when read and executed by one or more processing units or processors in a computer, cause the computer to perform operations to execute elements involving the various aspects of the disclosure.

Moreover, while embodiments have been described in the context of fully functioning computers and computer systems, those skilled in the art will appreciate that the various embodiments are capable of being distributed as a program product in a variety of forms, and that the disclosure applies equally regardless of the particular type of machine or computer-readable media used to actually effect the distribution.

Further examples of machine-readable storage media, machine-readable media, or computer-readable (storage) media include but are not limited to recordable type media such as volatile and non-volatile memory devices, floppy and other removable disks, hard disk drives, optical disks (e.g., Compact Disk Read-Only Memory (CD-ROMs), Digital Versatile Disks, (DVDs), etc.), among others, and transmission type media such as digital and analog communication links.

In some circumstances, operation of a memory device, such as a change in state from a binary one to a binary zero or vice versa, for example, may comprise a transformation, such as a physical transformation. With particular types of memory devices, such a physical transformation may comprise a physical transformation of an article to a different state or thing. For example, but without limitation, for some types of memory devices, a change in state may involve an accumulation and storage of charge or a release of stored charge. Likewise, in other memory devices, a change of state may comprise a physical change or transformation in magnetic orientation or a physical change or transformation in molecular structure, such as from crystalline to amorphous or vice versa. The foregoing is not intended to be an exhaustive list in which a change in state for a binary one to a binary zero or vice-versa in a memory device may comprise a transformation, such as a physical transformation. Rather, the foregoing are intended as illustrative examples.

A storage medium typically may be non-transitory or comprise a non-transitory device. In this context, a non-transitory storage medium may include a device that is tangible, meaning that the device has a concrete physical form, although the device may change its physical state. Thus, for example, non-transitory refers to a device remaining tangible despite this change in state.

REMARKS

The language used in the specification has been principally selected for readability and instructional purposes, and it may not have been selected to delineate or circumscribe the inventive subject matter. It is therefore intended that the scope of the invention be limited not by this Detailed Description, but rather by any claims that issue on an application based hereon. Accordingly, the disclosure of various embodiments is intended to be illustrative, but not limiting, of the scope of the embodiments, which is set forth in the following claims.

The invention claimed is:

1. An apparatus to flatten a substrate along a print path of a printer, the apparatus comprising:

a first elongated resilient member disposed linearly along the print path;

a first capstan disposed transversely to the print path, the first elongated resilient member having a first terminal portion secured to the first capstan;

a first biasing member configured to apply rotational force to the first capstan, wherein rotation of the first capstan in connection with the first biasing member in a first direction applies tension to the first elongated resilient member, wherein the first elongated resilient member correspondingly applies pressure to the substrate as the substrate is moved along the print path by the printer to increase flatness of the substrate;

a first ratchet fitted to the first capstan to maintain a bias imparted to the first capstan by the first biasing member by securing the first capstan against rotation in a direction that would release the bias;

a second elongated resilient member coupled to the printer, the second elongated resilient member disposed linearly along the print path and parallel to the first elongated resilient member; and the first elongated resilient member and the second elongated resilient member operable to bend in response to a vertical force applied to the first and second elongated resilient members by a printhead associated with the printer, when the printhead is engaged in printing on the substrate.

2. An apparatus comprising:

a first elongated resilient member disposed linearly along a print path of a substrate through a printer;

a first capstan disposed transversely to the print path, the first elongated resilient member having a first terminal portion secured to the first capstan; and a first biasing member configured to apply rotational force to the first capstan, wherein rotation of the first capstan in connection with the first biasing member in a first direction applies tension to the first elongated resilient member, wherein the first elongated resilient member correspondingly applies pressure to the substrate as the substrate is moved along the print path by the printer to increase flatness of the substrate.

3. The apparatus of claim 2, comprising:

a ratchet fitted to the first capstan to maintain a bias imparted to the first capstan by the first biasing member by securing the first capstan against rotation in a direction that would release the bias.

4. The apparatus of claim 2, comprising:

a bar disposed transversely to the print path;

a first attachment port secured to the bar, the first attachment port supporting the first terminal portion of the first elongated resilient member;

a second attachment port secured to the bar, the second attachment port supporting a first terminal portion of a second elongated resilient member; and a transverse motion mechanism operable to move the first attachment port and the second attachment port toward each other, and away from each other, thereby adjusting a distance between the first elongated resilient member and the second elongated resilient member.

5. The apparatus of claim 4, the transverse motion mechanism comprising:

a first pulley located at a first terminal portion of the bar;

a second pulley located at a second terminal portion of the bar;

a belt looping around the first pulley and the second pulley and including a top portion and a bottom portion, wherein the top portion touches a top of the first pulley and the second pulley, wherein the bottom portion touches a bottom of the first pulley and the second pulley;

the first attachment port secured to the top portion of the belt;

the second attachment port secured to the bottom portion of the belt; and a motor disposed at the first terminal portion or the second terminal portion of the bar and operable to move the belt in a plurality of directions transverse to the print path, causing the first attachment port and the second attachment port to move toward or away from each other, depending on a direction in the plurality of directions.

6. The apparatus of claim 5, the belt comprising a toothed belt, the toothed belt comprising at least one toothed surface, the toothed surface in contact with the first pulley and the second pulley.

7. The apparatus of claim 6, the first attachment port including an aperture operable to surround a tooth of the toothed belt, thereby at least partially securing the first attachment port to the toothed belt.

8. The apparatus of claim 2, comprising:

a bar disposed transversely to the print path;

a first attachment port secured to the bar, the first attachment port coupled to the first terminal portion of the first elongated resilient member;

an inductive sensor disposed at a terminal portion of the bar, the inductive sensor operable to contactlessly detect proximity of the first attachment port using electromagnetic induction; and a servo motor operable to calibrate a zero-position of the first attachment port at a position where the inductive sensor detects the first attachment port.

9. The apparatus of claim 2, the first biasing member comprising a torsion spring.

10. The apparatus of claim 2, comprising:

a first bar disposed transversely to the print path, the first bar disposed at a first terminal portion of the print path;

a first attachment port secured to the first bar, the first attachment port supporting the first terminal portion of the first elongated resilient member;

a second bar disposed transversely to the print path, the second bar disposed at a second terminal portion of the print path;

a second attachment port secured to the second bar, the second attachment port supporting the second terminal portion of the first elongated resilient member;

a first oblong aperture formed by the first attachment port enabling an coupling of the first terminal portion of the first elongated resilient member to the first attachment port, and enabling movement of the first terminal portion of the first elongated resilient member transverse to the print path; and movement of the first terminal portion of the first elongated resilient member enabling a parallel alignment of the first elongated resilient member and the print path.

11. The apparatus of claim 2, comprising:

a printhead associated with the printer and operable to:

assume a first position proximate the substrate, the first position enabling printing on the substrate, assume a second position removed from the substrate, the printhead not engaged in printing when in the second position, and tense the first elongated resilient member when the printhead is in the first position by exerting pressure on the first elongated resilient member, causing the first elongated resilient member to exert pressure on the substrate.

12. The apparatus of claim 2, comprising:

a printhead associated with the printer comprising a plurality of nozzles operable to deposit a print medium onto the substrate, a nozzle in the plurality of nozzles operable to tense the first elongated resilient member, causing the first elongated resilient member to exert pressure on the substrate; and a processor configured to:

determine the nozzle in the plurality of nozzles exerting pressure on the first elongated resilient member; and turn off the nozzle when the printhead is engaged in printing.

13. The apparatus of claim 2, comprising:

a second elongated resilient member coupled to the printer, the second elongated resilient member disposed linearly along the print path and parallel to the first elongated resilient member; and the first elongated resilient member and the second elongated resilient member operable to bend in response to a vertical force applied to the first and second elongated resilient members by a printhead associated with the printer, when the printhead is engaged in printing on the substrate.

14. The apparatus of claim 2, a cross-section of the first elongated resilient member having dimensions approximately 25 mm by 0.5 mm.

15. The apparatus of claim 2, a screw securing the first elongated resilient member to the first capstan.

16. The apparatus of claim 2, comprising:

a transport belt to move the substrate along the print path;

the first elongated resilient member removed approximately 50 mm from the transport belt, when not in contact with a printhead; and the first elongated resilient member removed approximately 3 to 4 mm from the transport belt when in contact with the printhead.

17. A method comprising:

providing a first elongated resilient member disposed linearly along a print path of a substrate through a printer;

providing a first capstan disposed transversely to the print path, the first elongated resilient member having a first terminal portion secured to the first capstan;

providing a first biasing member configured to apply rotational force to the first capstan, wherein rotation of the first capstan in connection with the first biasing member in a first direction applies tension to the first elongated resilient member, wherein the first elongated resilient member correspondingly applies pressure to the substrate as the substrate is moved along the print path by the printer to increase flatness of the substrate; and providing a ratchet fitted to the first capstan to maintain a bias imparted to the first capstan by the first biasing member by securing the first capstan against rotation in a direction that would release the bias.

18. The method of claim 17, comprising:

adjusting a distance between the first elongated resilient member and a transport belt associated with the printer and operable to carry the substrate along the print path by increasing tension in the first elongated resilient member through winding the ratchet.

19. The method of claim 17, comprising:

determining a nozzle in a plurality of nozzles associated with a printhead exerting pressure on the first elongated resilient member, wherein the nozzle in the plurality of nozzles exerts vertical pressure on the first elongated resilient member; and turning off the nozzle when the printhead is engaged in printing.

20. The method of claim 17, comprising:

calibrating a zero-position of an attachment port supporting the first elongated resilient member, when an inductive sensor associated with the printer detects a proximity of a first attachment port, wherein the attachment port is configured to move transversely to the print path and in line with the inductive sensor;

calculating a position of the first attachment port with respect to the zero-position; and causing the attachment port to move to the position.

* * * * *